United States Patent [19]

Zaruba et al.

[11] Patent Number: 4,852,886

[45] Date of Patent: Aug. 1, 1989

[54] BOARD GAME WITH STACKABLE TOKENS AND RANDOM MOVING DISRUPTER

[75] Inventors: John V. Zaruba, Chicago; Donald A. Rosenwinkel, Oak Park; Jeffrey D. Breslow, Highland Park, all of Ill.

[73] Assignee: Marvin Glass & Associates, Chicago, Ill.

[21] Appl. No.: 141,993

[22] Filed: Jan. 11, 1988

[51] Int. Cl.[4] ..... A63F 3/00

[52] U.S. Cl. ..... 273/249; 273/242; 273/290; 273/138 R

[58] Field of Search ..... 273/248, 249, 290, 288, 273/242, 243, 138 R

[56] References Cited

U.S. PATENT DOCUMENTS

| | | | |
|---|---|---|---|
| 4,192,512 | 3/1980 | Erickson et al. | 273/243 |
| 4,206,925 | 6/1980 | Goldfarb et al. | 273/248 |
| 4,333,655 | 6/1982 | Rudell et al. | 273/249 |
| 4,348,028 | 9/1982 | Barlow | 273/249 |

FOREIGN PATENT DOCUMENTS

| | | | |
|---|---|---|---|
| 2028148 | 3/1980 | United Kingdom | 273/288 |

*Primary Examiner*—Leo P. Picard
*Assistant Examiner*—Jessica J. Harrison
*Attorney, Agent, or Firm*—John S. Pacocha

[57] ABSTRACT

A game in which a number of players each attempt to move a plurality of assigned stackable playing tokens to the center of a board along one of four concentric spiral paths. Once a player has all of the assigned tokens on the path, a stack of tokens may be moved as a single token. Movement of the tokens is determined by the roll of two dice with players being able to move each of two single tokens the number of spaces along the path that are indicated on a respective die or move one single token the total of both dice. Also included is a windup spring motor random moving disrupter device constructed so as to increase the probability of knocking over a higher stack of tokens. When indicated by a die, the random moving disrupter is wound and released in an attempt to knock over tokens of the opposing players. Knocked over tokens are removed from the board and must be restarted on the path.

18 Claims, 1 Drawing Sheet

BOARD GAME WITH STACKABLE TOKENS AND RANDOM MOVING DISRUPTER

BACKGROUND OF THE INVENTION

1. Field of the Invention

This invention relates generally to games and more particularly to board games in which players race along a path.

2. Background Art

Simple board games in which players race assigned tokens along a path in accordance with chance determinations have long been popular pastimes for younger children. Two examples of such popular prior art board games are the Milton Bradley Chutes and Ladders game and the Milton Bradley Candy Land game. Hayes U.S. Pat. No. 3,649,021 issued Mar. 14, 1972 includes a random chance determinator positioned in the center of a board containing a path along which players move their assigned tokens. In the Hayes game, when an instruction card directs, a ball is dropped down the upstanding central random device which has a number of possible exit patterns, some of which may disrupt the assigned tokens on the path. Goldfarb, et al. U.S. Pat. No. 4,206,925 issued June 10, 1980 discloses a board game having linear paths with pieces adapted to be knocked over assigned to each player for movement along a selected path, a movable housing is positioned at the beginning of each player's turn at one end of the path and a knob atop the housing is turned to determine how may spaces the piece may be moved along the path. From time to time, turning of the knob in the Goldfarb, et al. game will release and propel a wheeled vehicle down the path to engage and knock down the piece on that path. Spring U.S. Pat. No. 4,431,190 issued Feb. 14, 1984 shows and describes a wheeled device for producing a random output for use in games such that rotating two wheels by moving the device across a surface will cause a member to move from a nonindicating position to an indicating position in a random manner depending upon random rotation of one of the wheels with respect to the other. However, there remains a need for relatively simple board games in which players race assigned tokens along a path with the chance of a device moving randomly around the board disrupting their attempt to reach the end of the path.

SUMMARY OF THE INVENTION

The present invention is concerned with providing a game in which a number of players each attempt to move a plurality of assigned playing tokens or pieces to the center of a board along one of four concentric spiral paths. Each spiral path has incremental spaces leading to the center of the board. The tokens are stackable upon each other and game rules provide that once a player has all of the assigned pieces on the path, a stack of tokens may be moved as a single token. Movement of the tokens is governed by the roll of a pair of dice with the players being able to move each of two single tokens the number indicated on a respective one of the dice or one single token the total indicated on both of the dice. Also included is a windup spring motor random moving disrupter device constructed so as to increase the probability of knocking over a higher stack of tokens. When indicated by a die, the random moving disrupter is wound and released in an attempt to knock over the tokens of the opposing players. Knocked over tokens are removed from the board and must be restarted on the assigned path.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
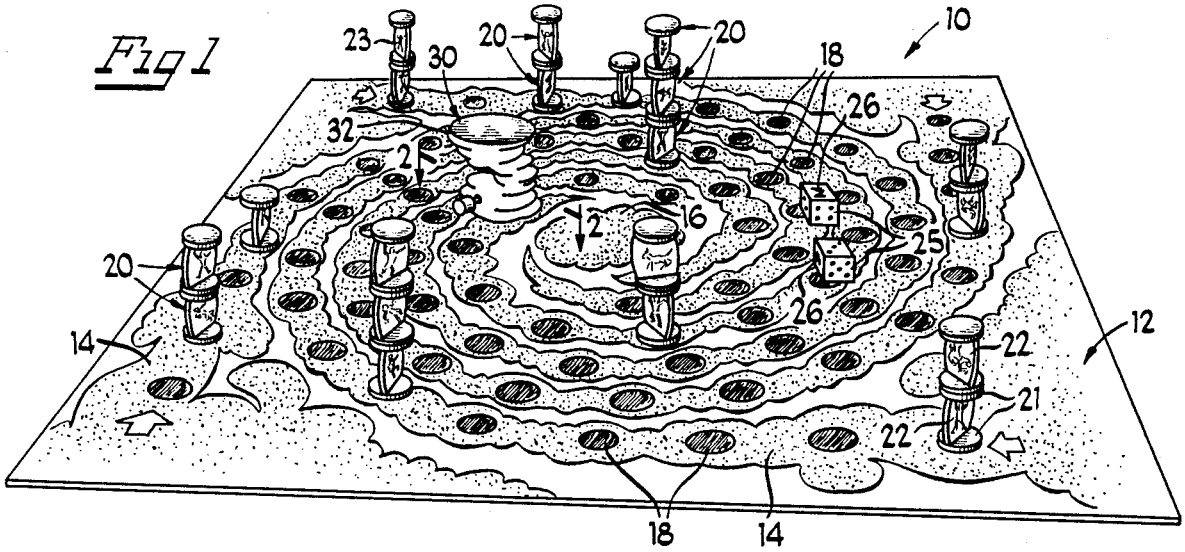
FIG. 1 is a perspective view of an embodiment of the present invention.

Referring now to the drawings in which like parts are designated by like reference numerals throughout the several views, FIG. 1 shows a game 10 including a board 12. Graphically defined on the board are four spiral paths 14. Each of the paths starts at a respective corner of board 12 and all lead to an open space goal 16 in the center of the board. Along each path 14 is the same number of incremental spaces 18.

Each player is conveniently provided with a set of five stackable playing tokens or pieces 20 that are distinguished from the opponent's playing tokens by color and/or some graphic design. The tokens should, however, all be of substantially the same shape and size. Provided each player has the same number of playing tokens, more or less than five tokens could be used for each player.

As illustrated in FIG. 1, each playing token 20 is made to stack upon another playing token 20 to form two-high, three-high, and even four-high stacks although the latter becomes somewhat precarious. Accordingly, each token has upper and lower flat disc portions 21 that are generally parallel to each other and are spaced apart by a generally transverse standard 22 disposed along a diameter of each of the discs. Standard 22 may bear a graphic design 23 distinguishing one set of playing tokens 20 from the other sets although it is probably more convenient and economical to mold each set of playing tokens 20 from a different colored plastic.

Also included in the game are a pair of six sided dice 25. Each die has faces numbered from one through five with the sixth side bearing an indication 26 of a cyclone or tornado.

Game 10 further includes a windup spring motor random moving disrupter device 30. The outer shell 32 of disrupter 30 has an enlarged, outwardly angled, upper portion. Extending out one side, near the bottom, is a knob 34 for winding up the spring motor 36.

Figure 2:
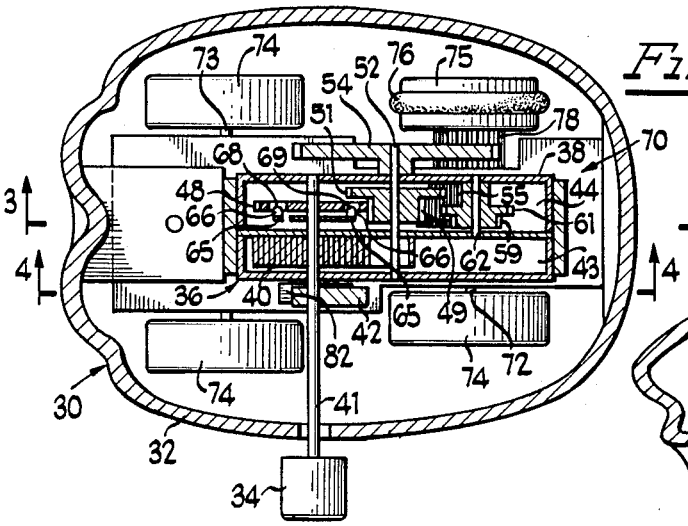
FIG. 2 is an enlarged scale sectional view taken generally along line 2—2 of FIG. 1.
Figure 3:
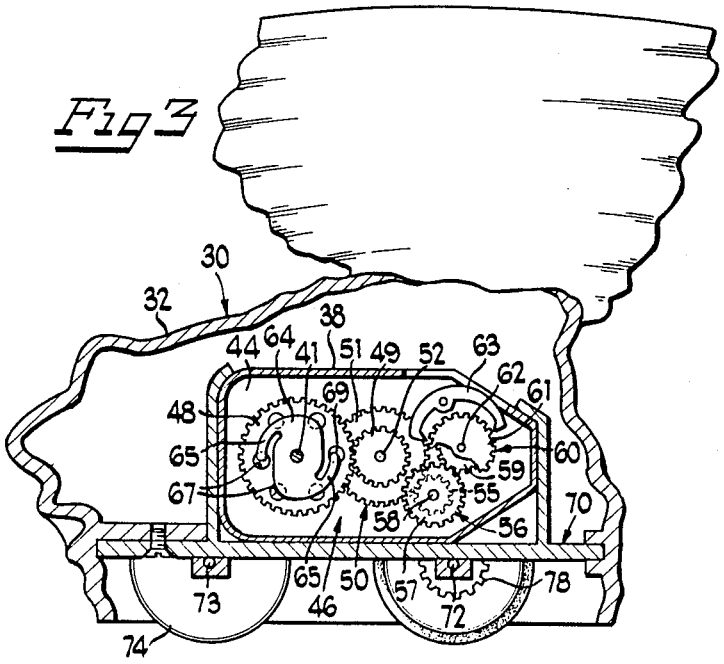
FIG. 3 is a sectional view taken generally along line 3—3 of FIG. 2.
Figure 5:
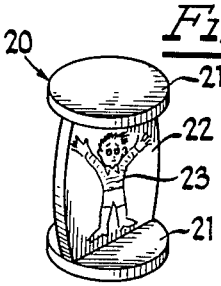
FIG. 5 is an enlarged scale perspective view of one of the playing tokens shown in FIG. 1.

Details of an exemplary wound spring motor useable with the present invention are shown in FIGS. 2 and 3. Spring motor 36 is contained within its own case 38 and is of a conventional design. The encased motor includes a conventional flat coiled spring 40 that is fixed at one end to a shaft 41 and connected at the other end to case 38.

Shaft 41 is journaled for rotation in opposed sides of case 38 with one end of the shaft extending outwardly and terminating in knob 34 which is secured for rotation with the shaft. Between knob 34 and case 38 is a single lobe cam 42 that is also secured on shaft 41 for rotation with the shaft. Spring 40 is retained within a separate chamber 43 of case 38, and an adjacent chamber 44 contains a governed gear train 46.

Within chamber 44 a large gear 48 is mounted on shaft 41 for free rotation relative to the shaft. Gear 48 meshes with the smaller diameter portion 49 of a dual diameter gear 50 that also has a larger diameter portion 51. Dual diameter gear 50 is mounted on a shaft 52 for rotation with shaft 52 which is journaled between opposed sides of the motor case. One end of shaft 52 protrudes out beyond case 38 from the side opposite that from which shaft 42 extends. Secured to the protruding end of shaft 52, for rotation with shaft 52, is a gear 54.

Large diameter gear 51 meshes with a small diameter portion 55 of another dual diameter gear 56 having a large diameter portion 57. Gear 56 is mounted on a shaft 58 for free rotation and drivingly, mates, through larger diameter portion 57, with a small diameter portion 59 of yet another dual diameter gear 60 having a larger diameter portion 61. A shaft 62 rotatably supports gear 60. The larger diameter portion 61 of gear 60 is engaged by a governer 63 to regulate the depletion of the stored energy of spring 40.

Transmission of torque through shaft 41 to speed increasing gear train 46 is controlled by the generally S-shaped, leaf spring clutch 64 which is fixed coaxially on shaft 41 for rotation with the shaft. Clutch 64 includes a pair of opposed, oppositely directed leaf spring arms 65, each having a cam 66 at the end.

Cams 66 are receivable within each of the plurality of angularly spaced apertures 67 in gear 48. Each cam 66 has an angled face 68 such that rotation of the clutch 64 in one direction biases cams 66 out of apertures 67 with the cams clicking from one aperture 67 to the next adjacent aperture 67. However, since an opposite face 69 of each cam 66 is generally parallel to the walls of apertures 67, rotation of clutch 64 in the opposite direction causes each of the cams to catch in a respective aperture 67. Gear 48 is thus only driven through the clutch 64 upon the unwinding of the spring 40. Accordingly, shaft 41 is rotated in one direction to wind spring 40 and is then driven in the opposite direction through the governed gear train by the unwinding of the spring at a slower speed than if the shaft were directly driven by a spring.

Motor casing 38 is mounted on a carriage 70 to which shell 32 is secured. Carriage 70 includes spaced apart axles 72 and 73. On each of the ends of axle 73 is a wheel 74 that is conveniently made of plastic. One end of axle 72 also has a wheel 74 mounted on it. Mounted on the other end of axle 72 for rotation with the axle is a wheel 75 that has a rubber, or other high coefficient of friction material, ring 76 around it. Between wheel 75 and casing 38, a gear 78 is secured on axle 72 for rotation with the axle. Gear 78 is in driven engagement with gear 54 of motor 36.

Carriage 70 carries a pin 80 for up and down movement transverse to axles 72 and 73 as well as the shafts 41, 52, 58 and 62 of motor 36. Pin 80 includes an enlarged upper head 82 that is engaged by single lobe cam 42 that rotates with shaft 41. The axis of pin 80 is generally aligned with, and disposed below, the center of shaft 41. Between the underside of head 82 and the opposite bottom end 83, pin 80 is longer than the thickness of carriage 70 plus the radius of a wheel 74.

Figure 4:
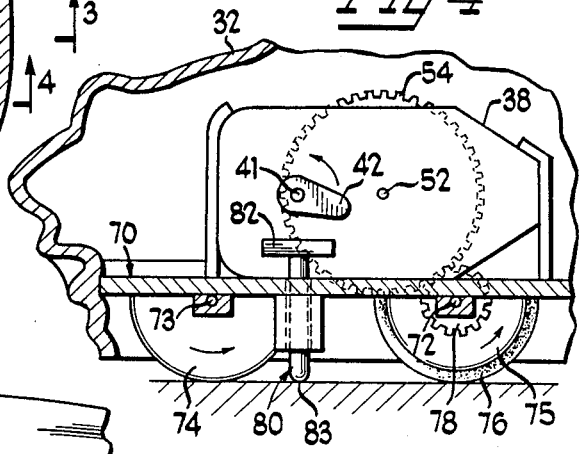
FIG. 4 is a sectional view taken generally along line 4—4 of FIG. 2.

When pin 80 is in contact with the surface of board 12, the top of head 82 is spaced from the center of shaft 41 a distance less than the length of the single lobe of cam 42. Accordingly, as illustrated in FIG. 4, when cam 42 is not in contact with head 82, the underside of head 82 is spaced from carriage 70. However, when cam 42 is driven into contact with head 82, pin 80 moves downwardly to effectively lift the rear wheels on axle 73 out of contact with the playing surface of board 12. Since wheel 75 continues to be driven by motor 36, the downward movement of pin 80 effects a relatively random change in direction of the device 30.

To play the game, a starting player, such as the one obtaining the highest roll of the dice, is selected. Players, in turn, throw the dice and move their assigned tokens on to the board, along incremental spaces 18 toward center space 16. When a token lands upon a space already occupied by another token they are stacked one upon the other. Once a player has all of the player's tokens on the path, a stack of tokens may be moved as a single token. Each of two single tokens, with each of the single tokens comprising either one lone token or a stack of tokens that may be moved as a single token, may be moved the number indicated on the upward face of a respective one of the dice. Alternatively, one single token may be moved the total indicated on both of the dice.

If indication 26 turns up on one die, the player must first move a single token the number of spaces indicated on the other die. The player having thrown the indication must then wind up and release disrupter 30 which moves about the board in a random manner knocking over tokens that it contacts. Should both dice turn up with indication 26, the player does not get to move any tokens in that turn and must wind up and release disrupter 30 twice.

Because of the upper portion of the disrupter that angles outwardly, the probability of a stack of two or three tokens being knocked over is greater than that of a lone token being knocked over. When a token or stack of tokens are knocked over, they are taken off the board and must be restarted on the path. The first player to get all of the tokens of the player's set into the center of the board wins the game.

While a particular embodiment of the present invention has been shown and described, changes and modifications will occur to those skilled in the art. It is intended in the appended claims to cover all such changes and modifications as fall within the true spirit and scope of the present invention.

What is claimed as new and desired to be secured by Letters Patent is:

1. A game comprising in combination:

a board providing a relatively flat playing surface;

a plurality of paths on the playing surface;

each of the paths having the same number of incremental spaces from one end of the path to the other end of the path;

a set of playing tokens for each path;

each set having the same number of playing tokens;

each playing token being stackable atop another playing token of the same set; and means self-propelled by a motor carried by the means with the motor also effecting a periodic change in direction of the means so that the means is self-propelled about the playing surface in a random manner capable of knocking over playing tokens in more than one of the paths upon contact with the playing tokens.

2. The game of claim 1 in which the random moving self-propelled means has:

a lower portion in contact with the playing surface; and an upper portion that angles outwardly from the lower portion and the playing surface to increase the probability of knocking over a stack of two or more playing tokens as compared to the probability of knocking over a single playing token.

3. The game of claim 2 in which each of the playing tokens comprises a pair of substantially flat discs spaced from and parallel to each other with an upright member between the discs maintaining the discs in their spaced parallel relationship.

4. The game of claim 3 including means distinguishing the tokens of one set from each other set.

5. The game of claim 3 in which all of the paths lead to a common goal.

6. The game of claim 5 in which:

the playing surface is rectangular;

there are four paths; and each path starts in a respective corner of the board and ends in a common center space.

7. The game of claim 6 in which the paths are concentric spirals.

8. The game of claim 3 including means for chance determination of the number of moves allowed the playing tokens.

9. The game of claim 3 in which the upright member is a standard lying in a plane that is generally transverse to the parallel disks and is disposed along a diameter of each of the disks.

10. The game of claim 1 in which each of the playing tokens comprises a pair of substantially flat discs spaced from and parallel to each other with an upright member between the discs maintaining the discs in their spaced parallel relationship.

11. The game of claim 10 in which the upright member is a standard lying in a plane that is generally transverse to the parallel disks and is disposed along a diameter of each of the disks.

12. The game of claim 1 in which all of the paths lead to a common goal.

13. The game of claim 12 in which:

the playing surface is rectangular;

there are four paths; and each path starts in a respective corner of the board and ends in a common center space.

14. The game of claim 13 in which the paths are concentric spirals.

15. A game for a plurality of players comprising in combination:

a board providing a relatively flat playing surface and containing a path;

a set of playing tokens for each player; and means self-propelled by a motor carried by the means with the motor also effecting a periodic change in direction of the means so that the means is self-propelled about the playing surface in a random manner capable of knocking over a playing token upon contact with the playing token.

16. The game of claim 15 in which each playing token is stackable atop another playing token of the same set and the random moving self-propelled means has a lower portion in contact with the playing surface and an upper portion that angles outwardly from the lower portion and the playing surface to increase the probability of a stack of playing tokens being knocked over as opposed to a lone playing token being knocked over.

17. The game of claim 16 in which each of the playing tokens comprises a pair of substantially flat disks spaced from and parallel to each other with an upright standard lying in a plane generally transverse to the parallel disks being disposed along a diameter of each of the disks to maintain the disks in a spaced apart parallel relationship.

18. The game of claim 15 in which the path is curved.

* * * * *